US006550441B1

(12) United States Patent
Drangel et al.

(10) Patent No.: US 6,550,441 B1
(45) Date of Patent: Apr. 22, 2003

(54) ARRANGEMENT FOR PREVENTING BEARING-RELATED NOISE IN INTERNAL COMBUSTION ENGINES

(75) Inventors: Hans Drangel, Stockholm (SE); Hans Göransson, Sodertalje (SE)

(73) Assignee: SAAB Automobile AB (SE)

( * ) Notice: Subject to any disclaimer, the term of this patent is extended or adjusted under 35 U.S.C. 154(b) by 0 days.

(21) Appl. No.: 09/936,889

(22) PCT Filed: Mar. 14, 2000

(86) PCT No.: PCT/SE00/00498

§ 371 (c)(1),
(2), (4) Date: Nov. 15, 2001

(87) PCT Pub. No.: WO00/55483

PCT Pub. Date: Sep. 21, 2000

(30) Foreign Application Priority Data

Mar. 18, 1999 (SE) ..... 9900986

(51) Int. Cl.[7] ..... F02B 75/04

(52) U.S. Cl. ..... 123/195 R; 123/48 C; 123/78 C

(58) Field of Search ..... 123/195 R, 48 C, 123/48 R, 78 C, 195 H, 195 AC

(56) References Cited

U.S. PATENT DOCUMENTS

| | | | | |
|---|---|---|---|---|
| 2,770,224 A | | 11/1956 | Ericson | 123/48 C |
| 3,450,111 A | | 6/1969 | Cronstedt | 123/78 |
| 3,633,552 A | * | 1/1972 | Huber | 123/48 R |
| 4,174,683 A | | 11/1979 | Vivian | 123/48 C |
| 5,025,757 A | * | 6/1991 | Larsen | 123/48 R |
| 5,329,893 A | | 7/1994 | Drangel et al. | 123/78 C |
| 5,443,043 A | | 8/1995 | Nilsson et al. | 123/48 C |
| 5,562,069 A | | 10/1996 | Gillbrand et al. | 123/48 C |
| 5,611,301 A | * | 3/1997 | Gillbrand et al. | 123/48 C |

FOREIGN PATENT DOCUMENTS

| | | | | |
|---|---|---|---|---|
| JP | 07026981 A | * | 1/1995 | F02B/75/04 |

* cited by examiner

*Primary Examiner*—Henry C. Yuen
*Assistant Examiner*—Hai Huynh
(74) *Attorney, Agent, or Firm*—Ostrolenk, Faber, Gerb & Soffen, LLP

(57) ABSTRACT

Internal combustion engine with variable compression, comprising a crankshaft-bearing crankcase part and a cylinder-receiving part arranged tiltably thereon by means of a tilt axle bearing on one side of the engine and a tilt mechanism on the other, opposite side of the engine. The cylinder-receiving part supports a cylinder head which is securely connected thereto, preferably with camshafts mounted therein. There are prestressing members arranged between the crankcase part and the cylinder-receiving part which force these engine parts apart and work to counteract the occurrence of bearing play in the tilt axle bearing and in the tilt mechanism when compression-modifying tilting movement between the cylinder-receiving part and the crankcase part occurs during running of the engine.

21 Claims, 3 Drawing Sheets

ARRANGEMENT FOR PREVENTING BEARING-RELATED NOISE IN INTERNAL COMBUSTION ENGINES

The present invention relates to an internal combustion engine having a crankcase part and a cylinder receiving part which are tiltably mounted with respect to each other and particularly relates to control of the tilting.

In this type of internal combustion engine, the compression can be varied by means of the fact that the engine's cylinder-receiving part (with associated cylinder head) can be tilted (inclined) to the side in relation to the crankcase part. To permit this, the cylinder-receiving part is mounted tiltably on the crankcase part on one side of the engine, and is connected movably to the crankcase part on the other, opposite side of the engine, by way of a tilt mechanism located there.

PRIOR ART

Internal combustion engines of the abovementioned type are already known, and in this connection reference may be made, for example, to U.S. Pat. No. 2,770,224 and SE-B-470 238.

The first of these patent specifications describes a piston engine with a fixed crankcase part, to which a cylinder-receiving engine part with associated cylinder cover is connected in an articulated manner. The combustion chamber volumes of the cylinders can be varied by tilting the cylinder-receiving engine part sideways about a longitudinal tilt axle. This tilting movement, i.e. change in the lateral inclination, is obtained by turning of an eccentric axle included in a tilt mechanism acting between the crankcase part and the cylinder-receiving engine part.

When the cylinder-receiving part (cylinder block) of an internal combustion engine, for example an in-line engine, of the abovementioned type is inclined (tilted) relative to the crankcase part, the distance between the crankshaft mounted in the crankcase part (with associated pistons linked to connecting rods) and the cylinders in the cylinder-receiving part changes. The volume of that part of the combustion chamber which lies above the respective piston's upper boundary surface (piston top) at the upper dead centre of the piston is thereby changed. The compression ratio of the engine can thus be varied in this way, and efficiency is thereby optimized for varying loading conditions. The performance of the engine and thus also of the vehicle in question is thereby improved.

OBJECT OF THE INVENTION

As a result of the above structural configuration of an internal combustion engine, and its principle of changing (varying) the compression in the cylinders by means of lateral tilting of the cylinder-receiving part in relation to the crankcase part of the engine, a certain amount of clearance or play arises both in the tilt axle bearing and in the various bearings of the tilt mechanism when the tilting movement in question takes place.

Since the tilt axle bearing on one side of the engine comprises a number of bearing lugs in the crankcase part, and a number of bearing lugs on the cylinder-receiving part which project into the spaces between these bearing lugs, and also a bearing axle passing through and connecting all these bearing lugs, it is necessary, for assembly technology reasons, to accept greater manufacturing tolerances, and thus greater bearing play, than it would be possible to achieve purely from the viewpoint of manufacturing technology.

This fact, together with the consideration that lubricant-free bearings ought in practice to be chosen —on account of small relative movements between interacting bearing components/bearing surfaces and the lack of sufficiently frequent changing of direction of force—means that the bearing play is quite great, thereby causing unwanted noise, especially at high loads.

The primary object of the present invention is to design an engine operating with variable compression in such a way that the occurrence of the abovementioned bearing-related noise can be prevented or at least to a large extent obviated.

DESCRIPTION OF THE INVENTION

According to the present invention, the above object is achieved by the fact that the engine has the features set out herein.

Thus, the primary distinguishing feature of the internal combustion engine is that, arranged between the crankcase part and the cylinder-receiving part there are prestressing members which force these engine parts apart and work to counteract the occurrence of bearing play in the tilt axle bearing and in the tilt mechanism when compression modifying tilting movement between the cylinder-receiving part and the crankcase part occurs during running of the engine.

Developments and preferred embodiments of the subject of the invention are also described.

Because the cylinder-receiving part with its associated cylinder head and the crankcase part are kept stressed apart in the manner indicated above, when the gas forces in the cylinders occur, the effect of the bearing play can be at least largely eliminated and the resulting noise in the engine can be prevented.

The internal combustion engine can, for example, be a four-cylinder, five-cylinder or six-cylinder in-line engine with overlying camshafts mounted in the cylinder head securely connected to the cylinder-receiving part. It is possible (but not essential) for the cylinder head and the cylinder-receiving part to be fully integrated and constitute parts of one and the same monobloc piece (monobloc engine).

On one side of the engine, the cylinder-receiving part has bearing lugs for the hinge axle of the tilt bearing, and on the opposite side of the engine bearing lugs for the upper hinge axle of the tilt mechanism. The last-mentioned bearing lugs preferably constitute integral parts of the cylinder-receiving part. Arranged between the crankcase part and the upper hinge axle of the tilt mechanism there are link members which transmit the tilting movement and which serve to change the distance between the said upper hinge axle and an eccentric shaft which is mounted in the bearing lugs of the crankcase part and which constitutes the lower hinge axle of the tilt mechanism.

In a first main embodiment according to the invention, the prestressing members are arranged inside the bearing lugs of the tilt axle bearing and are intended, with their opposite ends, to press directly or indirectly in one direction against a tilt axle passing through the bearing lugs and mounted in the crankcase part, and, in the other direction, to press against a collar part fixed in relation to the cylinder-receiving part.

In this embodiment, it is also preferable for the tilt mechanism members to comprise rods like connecting rods coupled between, on the one hand, a first axle which runs through the hearing lugs connected securely to the cylinder-receiving part and, on the other hand, a second axle mounted eccentrically in the crankcase part, prestressing members being arranged in the rods and being intended, with their opposite ends, to press directly or indirectly against the first axle and the second axle, respectively, in order to generate a force stressing these two axles apart.

On that side of the second axle remote from the rod (link member) transmitting the tilting movement, prestressing members are also preferably arranged in the crankcase part which act between the crankcase part and the associated side of the second axle and are intended to exert pressure on the axle.

The prestressing members in both the bearing lugs of the tilt axle bearing and in the rods (link members) and the crankcase part can preferably comprise cylindrical spring stacks consisting of cup springs.

In a second, alternative embodiment according to the invention, in the area between the tilt axle bearing and the tilt mechanism, and inserted between the crankcase part and the cylinder-receiving part, there are prestressing members which tension these two parts apart and act between, on the one hand, a collar part rigidly connected to the crankcase part and, on the other hand, a collar part rigidly connected to the cylinder-receiving part.

The collar part rigidly connected to the cylinder-receiving part can then be a tightening screw provided with a specially designed head and serving to fix a cylinder lining support on the underside of the cylinder-receiving part.

The collar part rigidly connected to the crankcase part can for its part, for example, consist of one end of a prestressing bar screwed into the crankcase part.

In the last-mentioned embodiment, the prestressing members can expediently be powerful cylindrical screw springs tensioned between the opposing collar parts in question.

In general terms, however, as regards the prestressing members according to the invention, these can either be suitable compression springs or spring stacks, or other types of force generators, for example hydraulic force generators.

When the engine is an in-line engine and the prestressing members are arranged as in the abovementioned second main embodiment, it is preferable, for reasons of force symmetry, for the prestressing members to be placed in an axial row and distributed uniformly along the cylinder line, preferably in the areas between adjacent cylinders in the cylinder line.

BRIEF DESCRIPTION OF THE FIGURES

The invention will now be explained and clarified with reference to a number of illustrative embodiments which are shown in the attached drawings.

In the drawings.

DESCRIPTION OF ILLUSTRATIVE EMBODIMENTS

Figure 1:
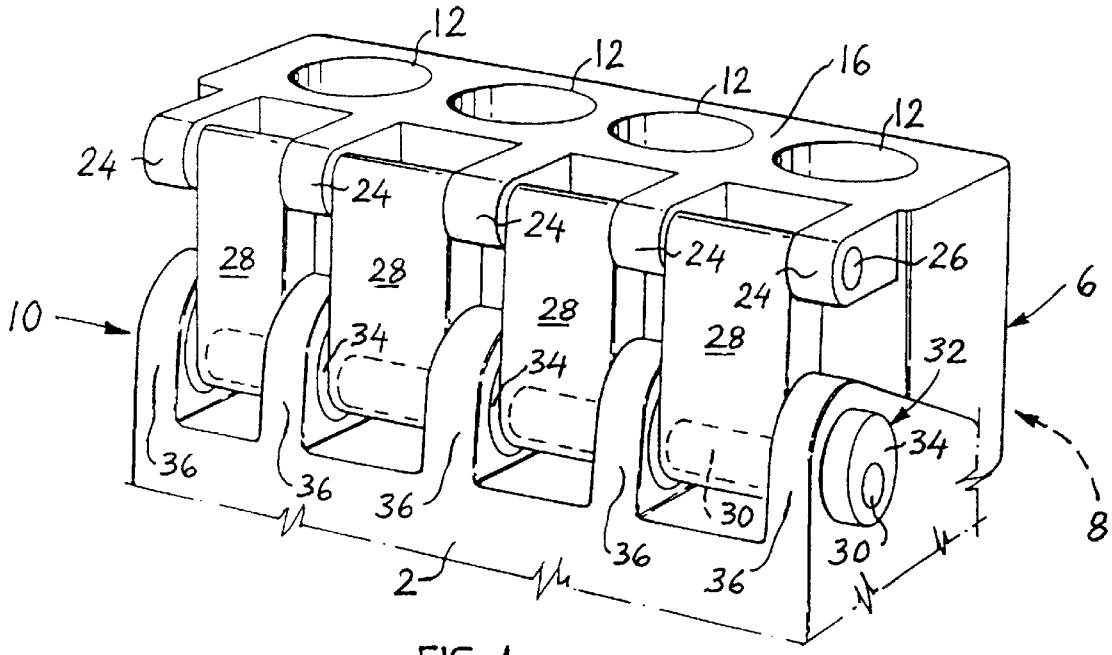
FIG. 1 shows a diagrammatic and perspective view of the main parts of the tilt mechanism in an internal combustion engine of the same basic type as the internal combustion engine according to the present invention.

The primary parts of an internal combustion engine of the type to which the present invention relates are shown in FIG. 1. The internal combustion engine, in this case a four-cylinder in-line engine, is constructed in such a way that its compression can be varied while running. The engine comprises a crankcase part 2, in which the crankshaft 4 (not shown here, but shown in FIG. 4) is mounted, and a cylinder-receiving part 6 which is connected tiltably to the crankcase part so that it can be inclined/tilted sideways in relation to the crankcase part. To permit this lateral tiltability of the cylinder-receiving part 6, a tilt axle bearing 8 is provided between the parts 2 and 6 on the furthest away long side (not shown here) of the engine, and on the long side of the engine visible here there is a tilt mechanism, generally designated by 10, between the crankcase part 2 and the cylinder-receiving part 6. The part 6 in this case contains four cylinders designated 12, and a cylinder head 14 or cylinder cover (not shown here, but indicated diagrammatically in FIG. 3) is in a conventional manner intended to be sealingly secured on the flat top 16 of the part 6.

Figure 2:
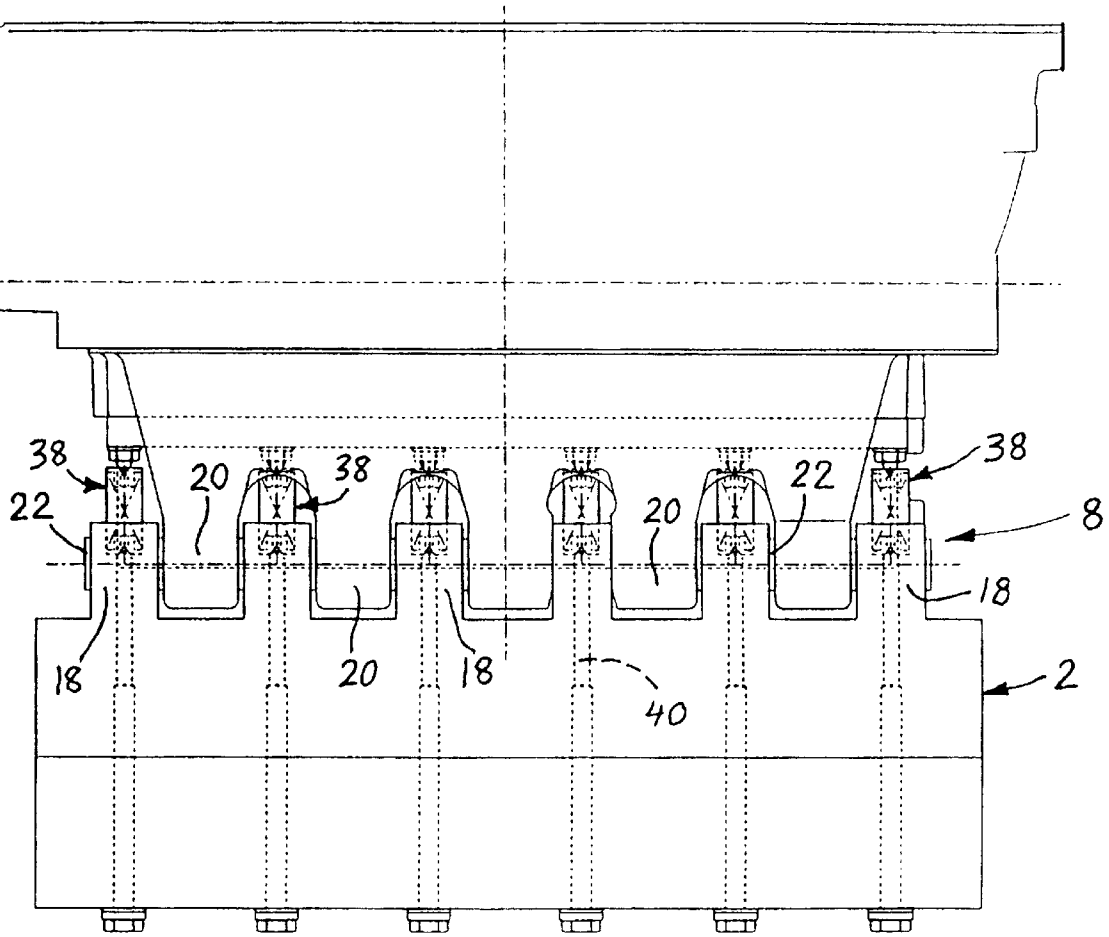
FIG. 2 shows a partial diagrammatic side view of the tilt axle bearing in an embodiment of an internal combustion engine according to the invention.

The tilt axle bearing 8 not visible in FIG. 1 comprises, in the same way as in the embodiment shown in FIG. 2, a number of bearing lugs 18 connected rigidly to the crankcase part 2 and a number of bearing lugs 20 which project upwards between these bearing lugs on the cylinder-receiving part 6. Passing through these bearing lugs 18, 20 there is a hinge axle 22 which thus couples the engine parts 2 and 6 in a hinged/tiltable manner. The number of bearing lugs of the parts 2 and 6 is of course dependent on the number of cylinders in the engine; note that the engine in FIG. 1 has four cylinders, while the engine in FIG. 2 has five cylinders.

The tilt mechanism 10 shown in FIG. 1 comprises five bearing lugs 24 which are rigidly connected to the cylinder-receiving part 6 and form bearing brackets for an upper hinge axle 26 which runs through them and on which rods/links or connection members 28 are pivotably mounted, the lower ends of these being pivotably mounted on "crank-like" axle sections 30 of an eccentric axle 32 with larger bearing sections 34 rotatably mounted in bearing brackets of bearing lugs 36 of the crankcase part 2. A rotation of the eccentric axle 32 generates a change in the distance between the upper hinge axle 26 and the axle sections 30, and thus via the connection members 28 a sideways tilting/inclination of the cylinder-receiving part 6 in relation to the crankcase part 2. The desired compression change in the cylinders is obtained in this way.

Figure 3:
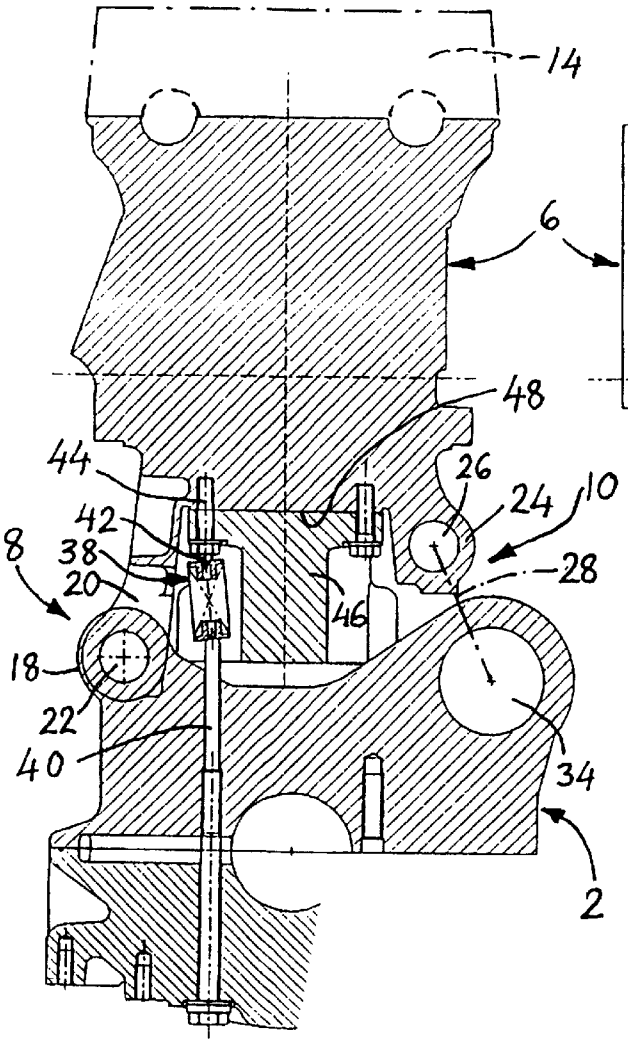
FIG. 3 shows a diagrammatic cross section through the engine in FIG. 2.

Reference is now made to the embodiment of the internal combustion engine according to the invention as shown in FIGS. 2 and 3. In order to prevent occurrence of noise related to bearing play during running of the engine, both in the tilt axle bearing 8 and in the tilt mechanism 10, prestressing members 38 are arranged between the crankcase part 2 and the cylinder-receiving part 6, which prestressing members 38 are in the form of powerful compression springs which by means of their inherent predetermined tensioning seek continually to press the engine parts 2 and 6 apart so that existing bearing play in the tilt axle bearing 8 and in the tilt mechanism 10 is eliminated in the direction generated by the action of the combustion gases in the cylinders. The pressure of the combustion gases in the combustion chambers in the cylinders seeks to threw the cylinder-receiving part 6 with associated cylinder head upwards, away from the crankcase part 2.

Each of the prestressing members 39 designed as compression springs is inserted between, on the one hand, the end of an associated prestressing bar 40 screwed into the crankcase part 2 and, on the other hand, a collar part 42 rigidly connected to the cylinder-receiving part 6. In this case, the collar parts 42 consist of the cup-shaped heads of fastening screws 44 which are still present at the appropriate sites and which are used for fastening a cylinder lining support 46 on the underside 48 of the cylinder-receiving part 6.

Figure 4:
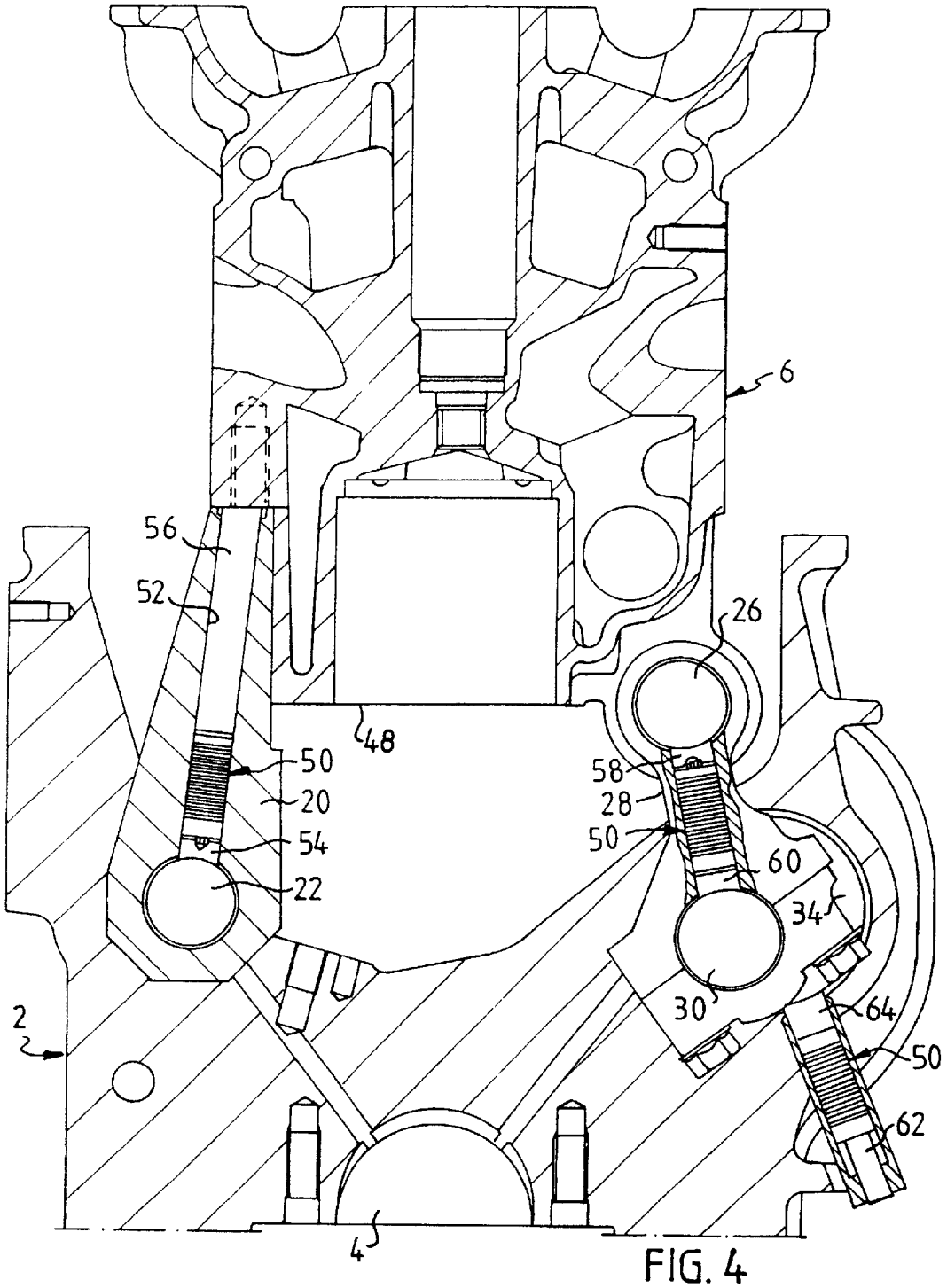
FIG. 4 shows a diagrammatic cross section through an alternative embodiment of an internal combustion engine according to the invention.

Referring is finally made to the alternative embodiment of the internal combustion engine according to the invention as shown in FIG. 4. The prestressing members between the crankcase part 2 and the cylinder-receiving part 6 are in this case positioned and designed differently from the design according to FIGS. 2 and 3.

Prestressing members 50, here in the form of cylindrical cup springs, are in this case inserted in bores 52 inside bearing lugs 20 belonging to the cylinder-receiving part 6 of the tilt axle bearing 8, where the prestressed members 50 exert pressure at the lower end against the hinge axle 22 and at the upper end against a collar part fixed in relation to the cylinder-receiving part 6. Force transmission between the members 50 and the hinge axle 22 takes place via pressure blocks 54 with cylindrically concave sliding contact surface against the axle 22. At the upper end of each prestressing member 50, the force transmission to the engine part 6 takes place via a pressure rod 56 inserted into the bore 52, which bar thus constitutes the collar part.

On the side of the engine with the tilt mechanism, there are two prestressing members 50 in and on each link-like connection member 28. Inside each connection member 28, there is a prestressing member 50 whose ends exert pressure on the upper hinge axle 26 and on the axle section 30 via pressure blocks 58 and 60, respectively, with cylindrically concave sliding contact surfaces. Also arranged on the side of the eccentric shaft 32 remote from the connection members 28, there are prestressing members 50 which each act between a part 62 rigidly connected to the crankcase part 2 and, on the other hand, the bearing section 34 of the eccentric shaft 32. The contact with the bearing section 34 is via a pressure block 64 with cylindrically concave sliding contact surface.

What is claimed is:

1. An internal combustion engine with variable compression, the engine comprising:

a crankcase part through which a crankshaft may pass;

a cylinder receiving part for receiving engine cylinders;

a tilt axle bearing between the crankcase part and the cylinder receiving part, extending along the parts and connecting the parts to enable them to tilt relative to each other;

a tilt mechanism between the crankcase part and the cylinder receiving part and located on the engine away from the tilt axle bearing and operable for tilting the parts with respect to each other around the tilt axle bearing;

pre-stressing members between the crankcase part and the cylinder receiving part normally urging the crankcase part and the cylinder receiving part to tilt away from each other and to counteract any bearing play in the tilt axle bearing and in the tilt mechanism during running of the engine and during engine compression.

2. The engine of claim 1, further comprising a cylinder head connected on the cylinder receiving part.

3. The engine of claim 2, wherein the cylinder head and the cylinder receiving part are integral parts of a monobloc component.

4. The engine of claim 1, wherein the engine has opposite lateral sides, the tilt axle bearing is toward one of the opposite lateral sides and the tilt mechanism is at at least in part toward the other of the opposite lateral sides.

5. The engine of claim 4, wherein the cylinder receiving part has a plurality of cylinders therein, arranged along at least one row, and the one and opposite sides of the engine are on opposite sides of the at least one row of the cylinders.

6. The engine of claim 1, wherein the tilt axle bearing comprises bearing lugs rigidly connected to the cylinder receiving part.

7. The engine of claim 6, wherein the tilt axle bearing includes a tilt axle passing through the bearing lugs.

8. The internal combustion engine of claim 6, wherein the mechanism comprises bearing lugs rigidly connected to the cylinder receiving part.

9. The engine of claim 8, further comprising a collar fixed on the cylinder receiving part;

the pre-stressing members being arranged inside the bearing lugs of the tilt axle bearing, the pre-stressing members having opposite first and second ends, and the first ends thereof pressing directly or indirectly in one direction against a tilt axle passing through the tilt axle bearing lugs, the tilt axle being disposed in the crankcase part and the second ends of the pre-stressing members pressing directly or indirectly in the other direction against the collar fixed to the cylinder receiving part.

10. The engine of claim 9, further comprising a first axle running through the bearing lugs of and rigidly connected to the cylinder receiving part, a second axle mounted eccentrically in the crankcase part, the tilt members comprise connecting rods, the connecting rods being coupled between the first and second axles;

the pre-stressing members being arranged in the rods and the opposite first and second ends of the pre-stressing members pressed directly or indirectly against the first and second axles respectively in order to generate a force which stresses the first and second axles apart.

11. The engine of claim 10, wherein the second axle has a first side toward the rod and a second side remote from the rod; the pre-stressing members arranged in the crankcase part act between the crankcase part and the associated first side of the second axle for exerting pressure on the second axle.

12. The internal combustion engine of claim 1, wherein the tilt mechanism comprises other bearing lugs rigidly connected to the cylinder receiving part.

13. The engine of claim 12, wherein the tilt mechanism adjustable tilt members coupled between the crankcase part and the bearing lugs on the cylinder receiving part, the tilt members being so shaped and so connected with crankcase part and the bearing lugs on the cylinder receiving part, and operable to change the distance between the crankcase part and the bearing lugs on the cylinder receiving part for causing the tilting of the cylinder receiving part with respect to the crankcase part and thereby changing the compression ratio in the engine cylinder.

14. The engine of claim 13, wherein the tilt members are so connected as to adjust their effective length to cause the tilting.

15. The engine of claim 13, wherein the bearing lugs connected to the cylinder receiving part are integral parts thereof.

16. The bearings of claim 12, further comprising a collar fixed on the cylinder receiving part;

the pre-stressing members being arranged inside the bearing lugs of the tilt axle bearing, the pre-stressing members having opposite first and second ends, and the first ends thereof pressing directly or indirectly in one direction against the tilt axle passing through the bearing lugs, the tilt axle being disposed in the crankcase part and the second ends of the pre-stressing members pressing directly or indirectly in the other direction against the collar fixed to the cylinder receiving part.

17. The engine of claim 16, further comprising a first axle running through the bearing lugs of and rigidly connected to the cylinder receiving part, a second axle mounted eccentrically in the crankcase part, the tilt members comprise connecting rods, the connecting rods being coupled between the first and second axles;

the pre-stressing members being arranged in the rods and the opposite first and second ends of the pre-stressing members pressed directly or indirectly against the first and second axles respectively in order to generate a force which stresses the first and second axles apart.

18. The engine of claim 1, wherein the pre-stressing members are located in an area between the tilt axle bearing and the tilt mechanism.

19. The engine of claim 18, further comprising collars rigidly connected to the crankcase part and to the cylinder receiving part and the pre-stress members are applied to the collars.

20. The engine of claim 19, wherein the pre-stressing members comprise either a compression spring stack or hydraulic force generators.

21. The engine of claim 1, wherein the pre-stressing members comprise either a compression spring stack or hydraulic force generators.

* * * * *